US006402056B1

(12) United States Patent
Lin

(10) Patent No.: US 6,402,056 B1
(45) Date of Patent: Jun. 11, 2002

(54) OIL AEROSOL

(76) Inventor: Rick Lin, No. 36, Lane 321, Sec. 3, Been Yuan Street, Tainan (TW)

( * ) Notice: Subject to any disclaimer, the term of this patent is extended or adjusted under 35 U.S.C. 154(b) by 0 days.

(21) Appl. No.: 09/742,235

(22) Filed: Dec. 22, 2000

(51) Int. Cl.[7] ..... B05B 9/04

(52) U.S. Cl. ..... 239/373; 222/401

(58) Field of Search ..... 239/373; 222/401, 222/400.8

(56) References Cited

U.S. PATENT DOCUMENTS 5,267,674 A * 12/1993 von Schuckmann ..... 222/396
5,749,502 A * 5/1998 Hinds ..... 222/386.5
6,045,011 A * 4/2000 Yang ..... 222/401

FOREIGN PATENT DOCUMENTS

FR 1202419 * 1/1960 ..... 239/373

* cited by examiner

*Primary Examiner*—Lesley D. Morris
(74) *Attorney, Agent, or Firm*—Rosenberg, Klein & Lee

(57) ABSTRACT

An oil aerosol has a can member and a compressing member. The can member has a covering part coupled to a can body. The compressing member has a holding tube fitted to the covering part, and received in the can body. A cap is movably disposed in, and has airtight connection with, the holding tube with an elastic member disposed on the bottom to bias same upwards. When the cap is moved up and down by depressing and releasing depressing element placed on the top of the cap, air will be forced into the can member through vent holes of both the cap and the holding tube to increase air pressure in the can member, permitting oil to be dispersed to outside through a nozzle when depressed; both the cap and the holding tube have non-return valves for permitting air to flow only in the above direction into the can member.

4 Claims, 4 Drawing Sheets

OIL AEROSOL

BACKGROUND OF THE INVENTION

The present invention relates to an oil aerosol, and particularly to one which can disperse edible oils or liquid cooking materials in the form of mist by means of compressed air.

To make food more delicious and beautiful, seasonings and edible oils are spread on the food. One of the conventional ways to do this is using a brush. The bristles of the brush are first dipped into an edible oil and then spread the edible oil on the food before cooking or eating.

However, it is found that the conventional way, using a brush to spread oil, has disadvantages as follows.

1. The bristles might fall off the brush, and pollute the oil and the food.
2. When the brush spreads on the food, the amount of the edible oil spread on the food would be too much in the beginning, and too little in the end, failing to spread evenly on the food.
3. The bristles would form scrapes on the food when rubbed against same, making the food look less attractive.
4. The edible oil would drop off the brush to the desk or the ground and dirty same.
5. It is difficult to clean or store the brush with oil after use.

A common sprayer used for spraying pomade would not be a good substitute for a brush because the chemicals used to produce pressure would cause environmental problems, and react with the edible oil to provide harmful substance endangering the eater.

SUMMARY OF THE INVENTION

Therefore, it is a main object of the present invention to provide an oil aerosol which can overcome the disadvantages of using a brush to spread oil, and is safe.

The oil aerosol of the present invention includes a can member and a compressing member.

The can member has a covering part fitted to a top end of a can main body. The covering part has a spray nozzle on it with a pipe disposed in the can main body.

The compressing member has a holding tube connected to the covering part, and received in the can main body. The holding tube has several vent holes on a lower portion having a non-return valve connected to a bottom side of the holding tube lower portion.

The compressing member further has a cap movably received in, and having airtight connection with, the holding tube; an elastic member is disposed under the cap to bias the cap upwards. The cap has a contact portion on a top side, and a lower portion each having vent holes. The cap lower portion has a non-return valve on it for permitting air to flow only downwards into the holding tube through the vent holes of the cap.

The cap is capable of being moved up and down by repeatedly depressing and releasing a depressing element removably disposed on the contact portion of the cap to force air into the can member through the vent holes.

Thus, pressure of the air in the can member is increased, permitting oil in the can member to be dispersed to outside in mist form from the nozzle when the nozzle is depressed.

BRIEF DESCRIPTION OF THE DRAWINGS

This invention will be better understood by referring to the accompanying drawings, wherein.

DESCRIPTION OF THE PREFERRED EMBODIMENT

Figure 1:
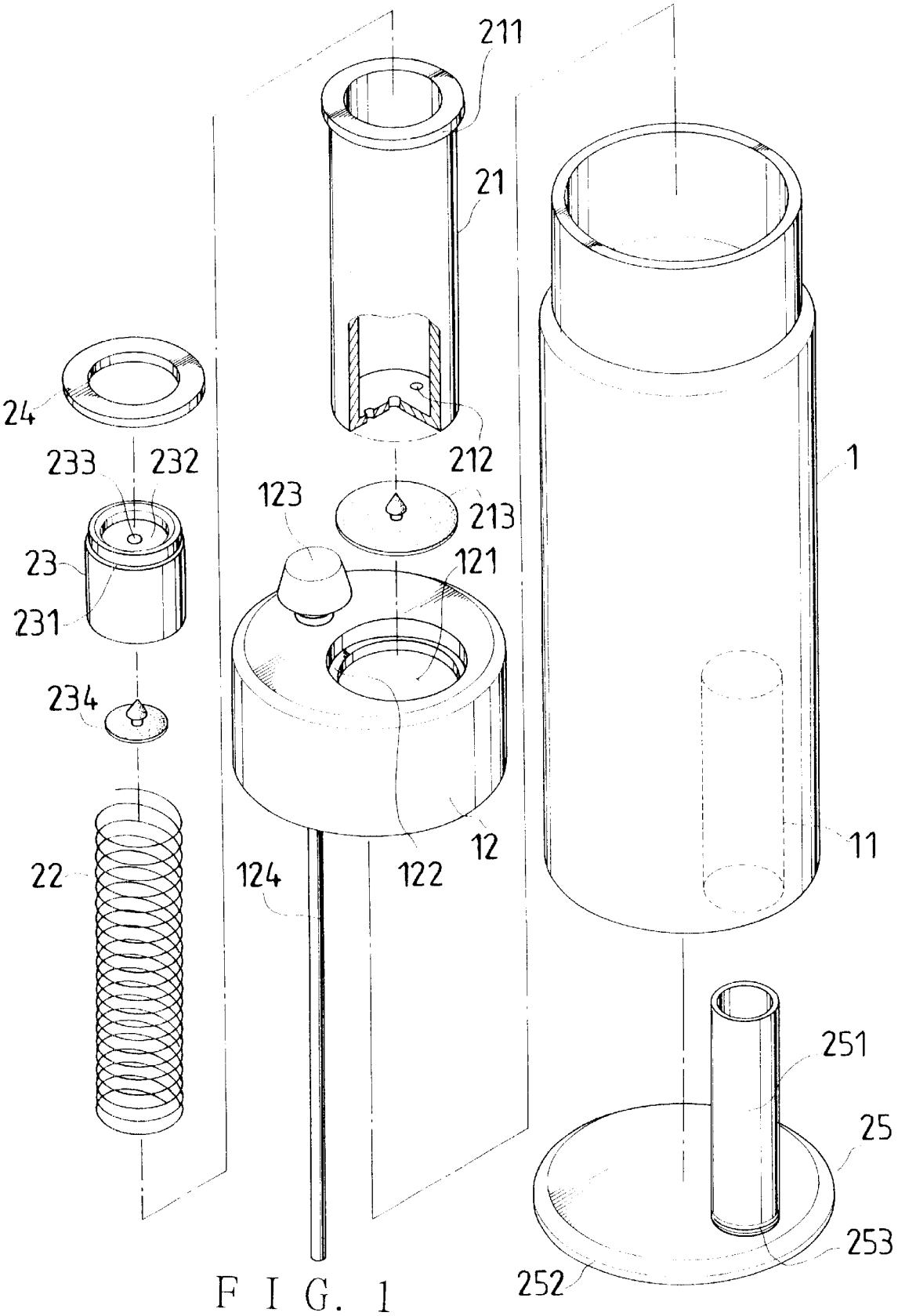
FIG. 1 is an exploded perspective view of an oil aerosol of the present invention.
Figure 2:
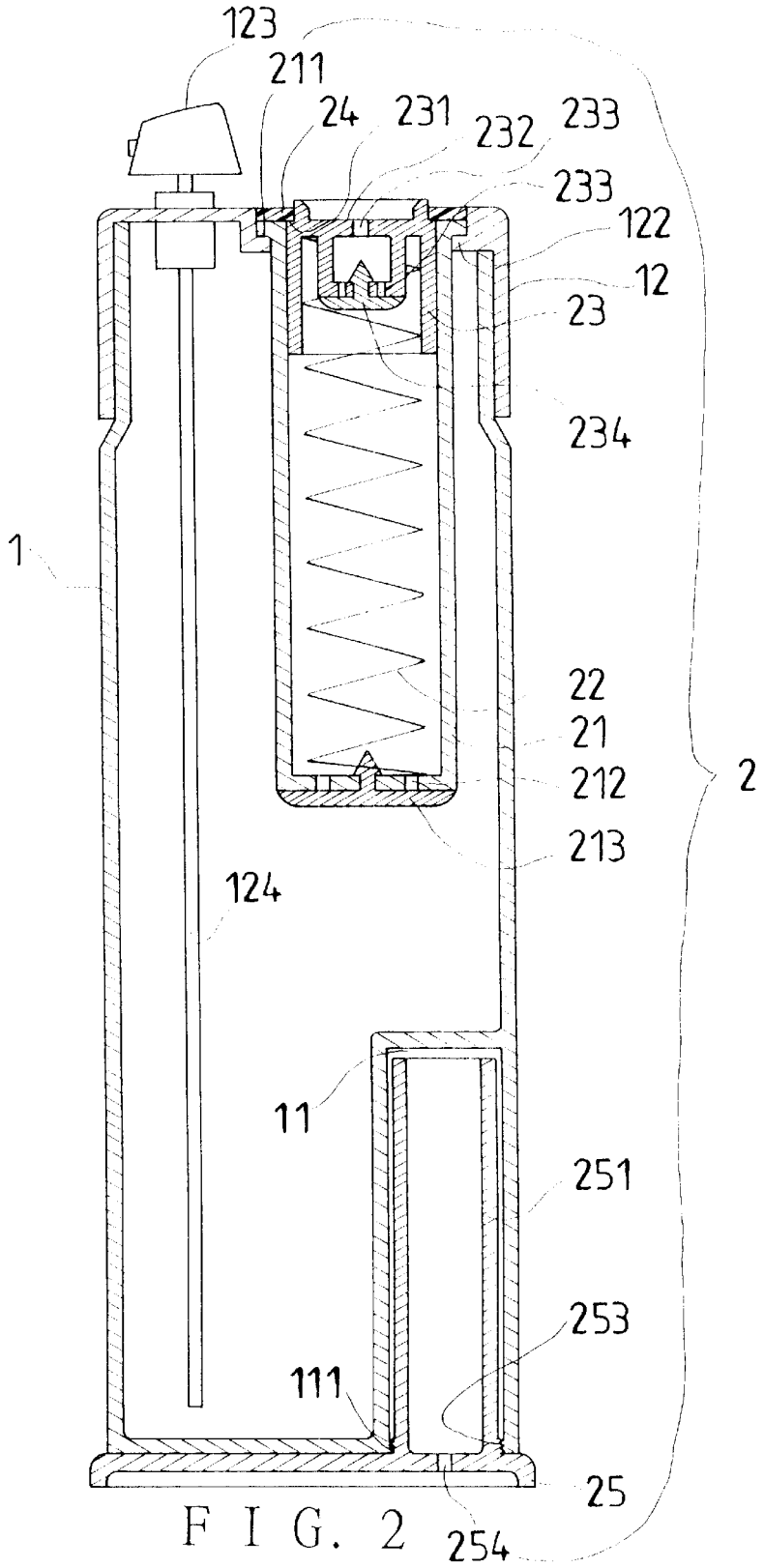
FIG. 2 is a cross-sectional view of the oil aerosol of the present invention.

Referring to FIGS. 1 and 2, an oil aerosol of the present invention includes a can member 1 and a compressing member 2.

The can member 1 has a can main body and a covering part 12. The covering part 12 is fitted to a top end portion of the can main body, and has a through hole 121 on a top side; a supporting annular protrusion 122 is formed on an inner side of the through hole 121. The covering part 12 further has a spray nozzle 123 fitted to the top side; the spray nozzle 123 is connected to a pipe 124 disposed in the can main body.

The can main body of the can member 1 has a holding tube 21, an elastic member 22, a cap 23, an upper confining ring 24 and a depressing element 25.

The holding tube 21 has an open top side, a rim 211 on the upper end portion, vent holes 212 on a bottom side and a non-return valve 213 disposed under and fitted to, the bottom side for permitting air to flow downwards through the vent holes 212. The holding tube 21 is received in the can member 1 with the rim 211 supported by the supporting annular protrusion 122 on the through hole of the covering part 12.

Figure 3:
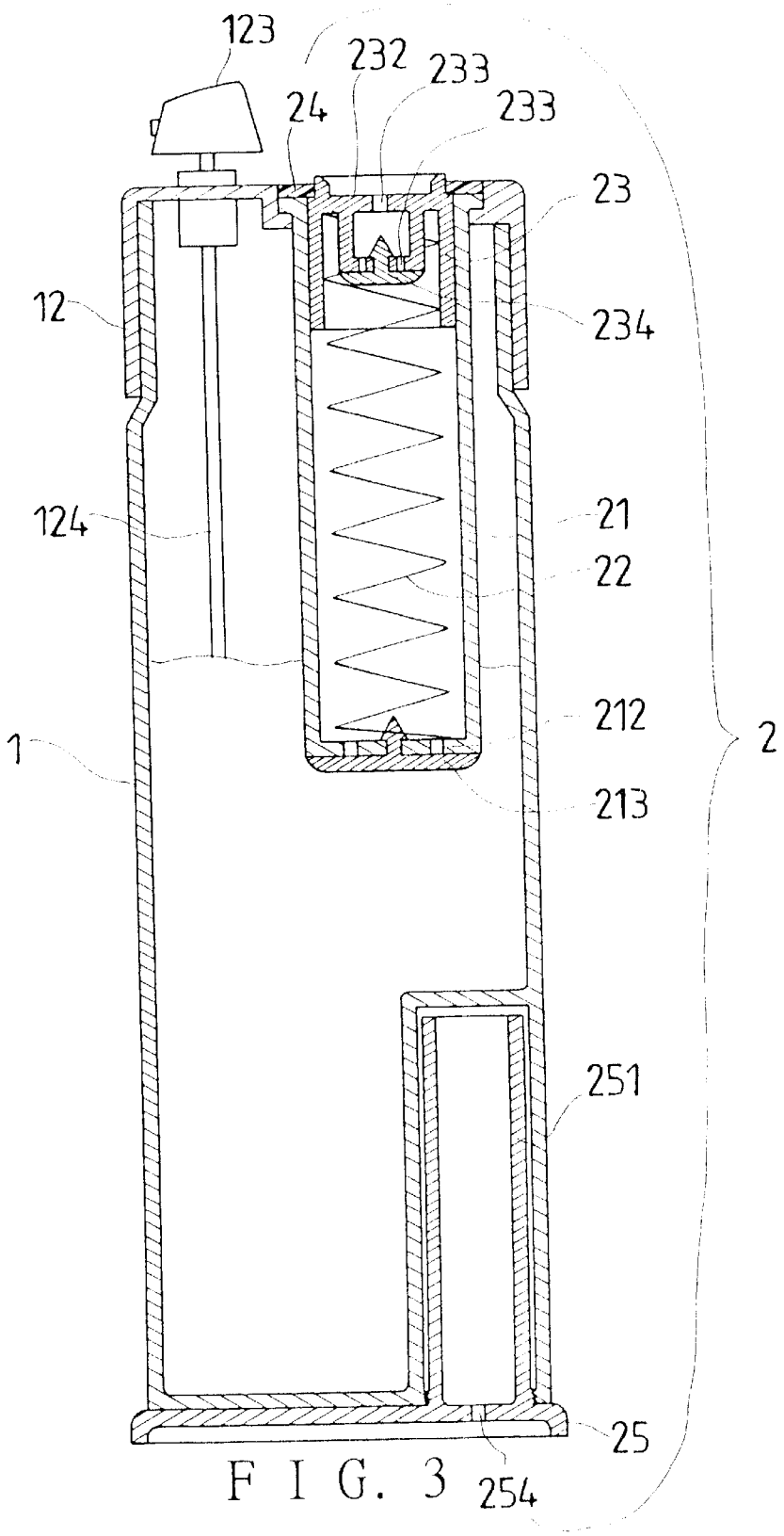
FIG. 3 is a cross-sectional view of the embodiment of the oil aerosol.

The elastic member 22 is disposed in the holding tube 21. The cap 23 has an upper recessed end portion 231, a contact portion 232, an upper vent hole 233 on the contact portion 232 and a non-return valve 234. Referring to FIGS. 2 and 3, the cap 23 further has several vent holes 233 on a lower portion. The non-return valve 234 is disposed under and fitted to, a bottom side of the lower portion for permitting air to flow only downwards through the lower vent holes 233. The cap 23 is disposed in the holding tube 21, on a top end of the elastic member 22 such that same is biased upwardly by the elastic member 22. The upper confining ring 24 is coupled to the rim, permitting only the upper recessed end portion 231 of the cap 23 to pass into, i.e. the cap 23 being stopped from moving further up by means of the upper confining ring 24. The cap 23 forms can airtight connection with an inner side of the holding tube 21, while the cap 23 is movable relative to the holding tube 21.

The depressing element 25 has a base part 252 and a tube part 251 projecting on the base part 252. The tube part 251 has threads on a lower end portion. The depressing element 25 can be separably connected to the bottom of the can member 1 with the tube part 251 passed into the socket 11, and the threads 253 screwed into the threads 111 of the socket 11 when not used. The depressing element 25 further has a vent hole 254 (FIG. 2) on the base part 252, in open communication with the tube part 251.

In using the oil aerosol of the present invention, first the depressing element 25 is removed from the bottom of the can member 1, and the top end of the tube part 251 is disposed on the contact portion 232 of the cap 23 of the compressing member 2 with the bottom side of the base 252 facing up for permitting the user to press with his hands.

Figure 4:
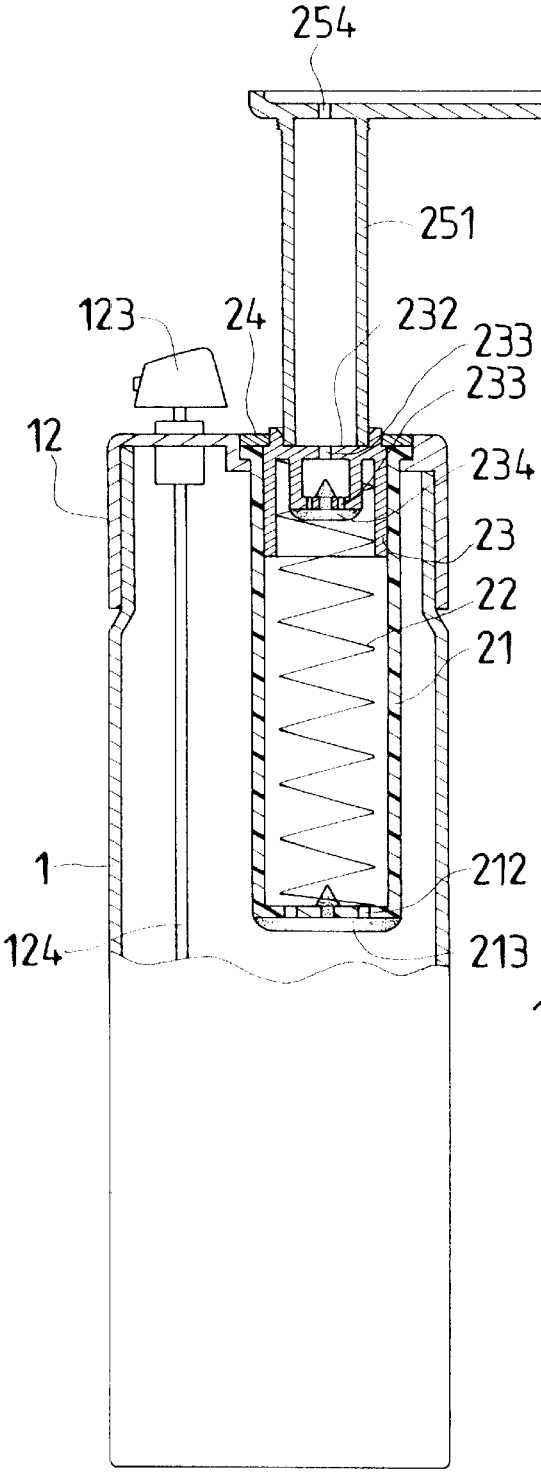
FIG. 4 is a cross-sectional view of the oil aerosol with the cap being depressed (step one).
Figure 5:
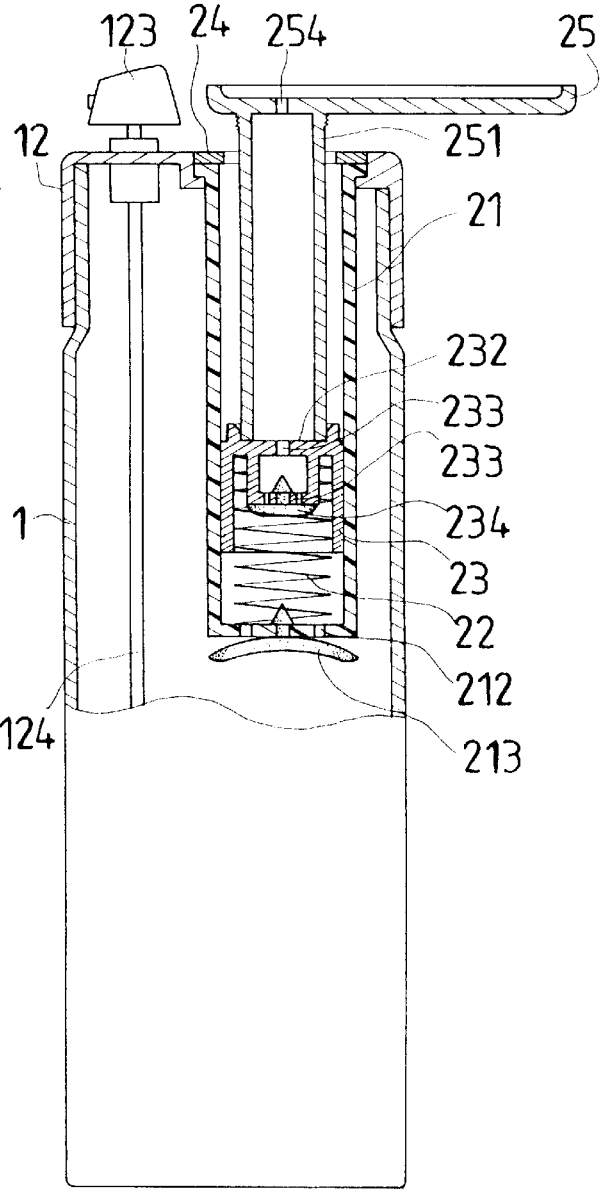
FIG. 5 is a cross-sectional view of the oil aerosol with the cap being depressed to a lowest position.

Then, the user depresses the depressing element 25, moving the cap 23 downwards (FIG. 5) to force air to flow into the can member 1 through the vent holes 212. When the user releases the depressing element 25, the elastic member 22 biases the cap 23 upwards (FIG. 4), making the inner part of the holding tube 21 substantially a vacuum. Thus, air will flow into the holding tube 21 through the vent holes 233 of the cap 23. So, after depressing and releasing depressing element 25 repeatedly, the air pressure in the can member 1 will be greater than the atmospheric pressure of the outside. Therefore, oil in the can member 1 can be dispersed through the nozzle 123 and the pipe 124 in the form of mist by compressed air in the can member 1, which is released when the nozzle 123 is pressed.

From the above description, the oil aerosol of the present invention can be seen to have desirable features as follows.

1. Using no brush, the oil aerosol would not be dirty, the food or the oil with fall-off bristles.
2. The food can be spread with oil mist evenly.
3. Using no brush, the oil aerosol would not form scrapes on the foods.
4. Using a nozzle as the outlet of the oil, the oil would not drop to the desk or the ground to dirty same.
5. The oil aerosol can be stored easily, and clean after use without the problem of washing the brush in the conventional way.
6. Using no chemicals to compress air, the oil is safe for the eaters.
7. When the oil in the can member runs out, oil can be added to the can member very easily, i.e. the oil aerosol can be used over and over again.
8. The depressing element can be connected to the bottom of the can member when not used, saving space for the user.

What is claimed is:

1. A oil aerosol, comprising a can member, said can member having a can main body and a covering part coupled to top end of said can main body; said covering part having a spray nozzle fitted thereto with a pipe disposed in said can main body;

a compressing member, said compressing member having a holding tube connected to said covering part, and received in said can member; said holding tube having a plurality of vent holes on a lower portion having a first non-return valve connected to a bottom side of said holding tube lower portion;

said compressing member having a cap movably disposed in, and having substantially airtight connection with, said holding tube with an elastic member disposed between said cap and said holding tube lower portion to bias said cap upwards; said cap having a contact portion above said lower portion; said contact portion and said lower portion of said cap having vent holes; said cap lower portion having a second non-return valve connected thereto for permitting air to flow only downwards into said holding tube through said vent holes of said cap;

said compressing member having a depressing element including a base part and tube part projecting on said base part; said depressing element having a vent hole on said base part in open communication with said tube part for permitting air to flow through same, and through said cap vent holes into said holding tube when said a top end of said depressing element tube part abuts said cap contact portion, and when said depressing element is depressed and released repeatedly to move said cap up and down;

said air in said holding tube being forced into said can member through said holding tube vent hole when said cap is being depressed for increasing air pressure in said can member, permitting oil in said can member to be dispersed to outside through said nozzle when said nozzle is depressed.

2. The oil aerosol as claimed in claim 1, wherein said holding tube has a rim on an upper end portion, and said covering part of said can member has a supporting annular protrusion on a through hole receiving said holding tube; said holding tube being located by means of connecting said rim to said supporting annular protrusion.

3. The oil aerosol as claimed in claim 1, wherein said cap has an upper recessed end portion and an upper confining ring is connected to a top end of said holding tube, permitting said upper recessed end portion of said cap to pass through, stopping other part of said cap from moving further up to confine said cap.

4. The oil aerosol as claimed in claim 1, wherein said can main body of said can member has a socket on a lower part for permitting said tube part of said depressing element to be received therein with said base part disposed under a bottom of said can member when said depressing element is not used; an inner side of said socket and an outer side of said tube part each having threads for permitting said tube part to be screwed into said socket.

* * * * *